US007191956B2

(12) United States Patent
Lin

(10) Patent No.: US 7,191,956 B2
(45) Date of Patent: Mar. 20, 2007

(54) DECORATIVE FOUNTAIN

(76) Inventor: Chung-Kuei Lin, 6F-4, No. 1, Wuchuan 1st Road, Wuku Industrial District, Hsinchuang City, Taipei Hsien (TW)

( * ) Notice: Subject to any disclaimer, the term of this patent is extended or adjusted under 35 U.S.C. 154(b) by 792 days.

(21) Appl. No.: 10/617,781

(22) Filed: Jul. 14, 2003

(65) Prior Publication Data

US 2005/0011966 A1 Jan. 20, 2005

(51) Int. Cl.
*B05B 17/08* (2006.01)
*F21V 33/00* (2006.01)

(52) U.S. Cl. ..... 239/17; 239/16; 239/18; 239/550; 239/558; 119/253; 362/96

(58) Field of Classification Search ..... 239/16, 239/17, 18, 20, 22, 23, 550, 558, 269, 275; 119/253, 255; 362/96, 101
See application file for complete search history.

(56) References Cited

U.S. PATENT DOCUMENTS 5,897,197 A * 4/1999 Lin ..... 362/101
6,439,471 B2 * 8/2002 Ehrlich et al. ..... 239/18
6,447,137 B1 * 9/2002 Long ..... 362/96
6,454,441 B1 * 9/2002 Lin ..... 362/294
6,592,055 B1 * 7/2003 Marino ..... 239/275
6,695,222 B1 * 2/2004 Lin ..... 239/17
6,705,540 B2 * 3/2004 Koshiyama et al. ..... 239/17

* cited by examiner

*Primary Examiner*—Kevin Shaver
*Assistant Examiner*—James S. Hogan
(74) *Attorney, Agent, or Firm*—Fei-Fei Chao; Andrews Kurth LLP

(57) ABSTRACT

A decorative fountain has a reservoir with a receiving space for receiving therein water, a pump received in the receiving space for pumping water in the reservoir upward, a base on the reservoir and having a through hole in alignment with the receiving space, a seat mounted around a periphery defining the through hole, a circuit board received in the seat, and a hollow frame on the base and provided with a hose received in the hollow frame and having an inlet extending to the aligned through hole and the receiving space and multiple outlets extending out from an inner periphery of the hollow frame. The outlets are so arranged that when the water in the receiving space is pumped upward and sprinkled out from the outlets, water trajectories from the outlets are interlaced with one another to present an interesting ornamental effect.

5 Claims, 4 Drawing Sheets

DECORATIVE FOUNTAIN

BACKGROUND OF THE INVENTION

1. Field of the Invention

The present invention relates to a decorative fountain, and more particularly to a decorative fountain which is able to spout water received in the reservoir in an interlaced manner to present an ornamental effect.

2. Description of Related Art

A common tabletop decorative fountain usually is provided with a reservoir for receiving therein water, a pump immersed in the water to pump the water upward through an inlet of a hose having an outlet defined in the hose such that when the pump is activated, the water will be pumped upward into the hose via the inlet and then the water in the hose will fall back into the reservoir via the outlet. The mono-function design of this fountain provides only a slight ornamental effect because after the observer watches the fountain for a period of time, the observer will find that it is quite boring watching the same design over and over again. The observer can not have any inspiration out of the rudimentary design.

To overcome the shortcomings, the present invention tends to provide an improved decorative fountain to mitigate the aforementioned problems.

SUMMARY OF THE INVENTION

The primary objective of the present invention is to provide an improved decorative fountain which is able to sprinkle water in an interlaced manner to provide an interesting ornamental effect.

Another objective of the present invention is to provide a circuit board in the base of the decorative fountain to control illumination and color change of light bulbs to provide a joyful and interesting effect far beyond that which the existing fountains can accomplish.

Other objects, advantages and novel features of the invention will become more apparent from the following detailed description when taken in conjunction with the accompanying drawings.

DETAILED DESCRIPTION OF THE PREFERRED EMBODIMENT

Figure 1:
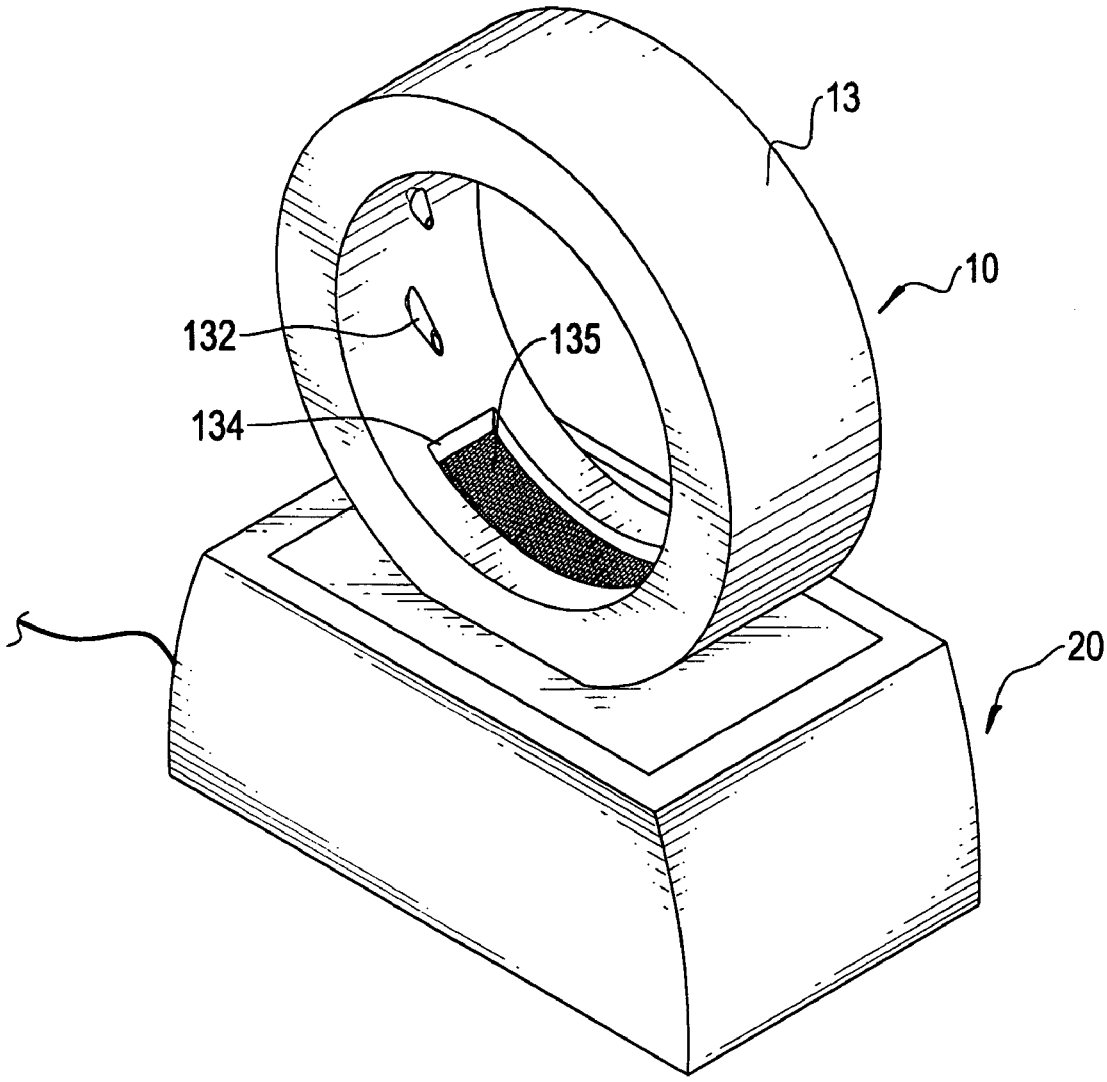
FIG. 1 is a perspective view of the decorative fountain of the present invention.

With reference to FIG. 1, the decorative fountain in accordance with the present invention has a body (10) and a reservoir (20) having the body (10) detachably supported thereon.

Figure 2:
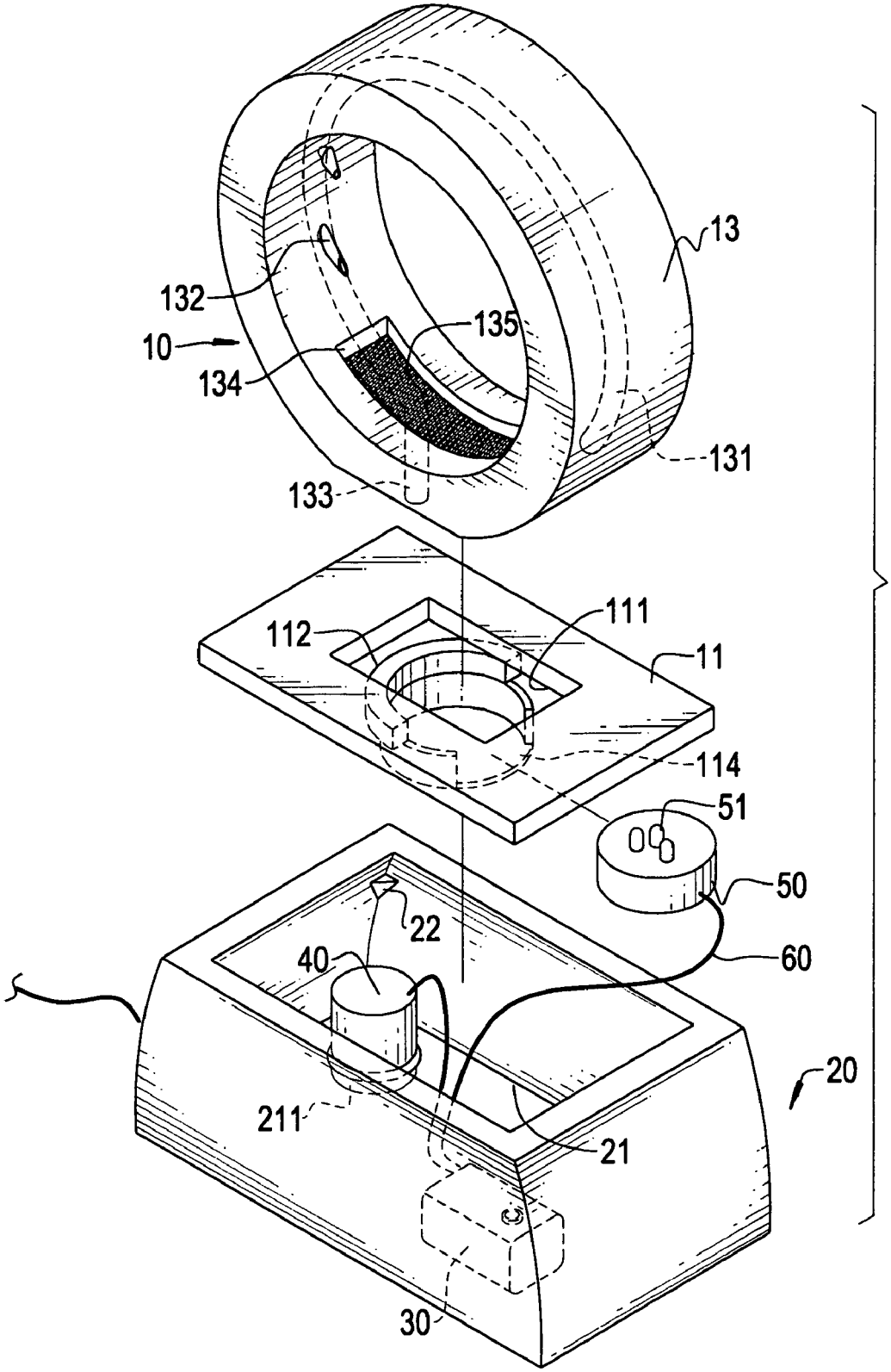
FIG. 2 is an exploded perspective view of the decorative fountain in FIG. 1.

With reference to FIG. 2, it is noted that the body (10) of the decorative fountain of the present invention has a hollow frame (13) with a hose (131) received inside the frame (13) and having multiple outlets (132) formed along an inner periphery of the hose (131) and extending out of the inner periphery of the hose (131), an opening (134) defined in a bottom of the inner periphery of the frame (13) and a screen (135) securely mounted on top of the opening (133) to cover the opening (133). The hose (131) further has an inlet (133) extending out of the opening (134). A base (11) is securely attached to a bottom of the hollow frame (13) and having a through hole (111) defined to correspond to the opening (133) of the frame (13), a flange (112) formed along a periphery defining the through hole (111) and a seat (113) securely connected to the flange (112) and provided with a side hole (114) defined in a side face of the seat (113).

The reservoir (20) is provided with a receiving space (21) for receiving water therein and ledges (22) formed between two adjacent side walls forming the receiving space (21).

A pump (30) is securely attached to a bottom face of the receiving space (21) and a plug (40) is applied to plug a drainage hole (211) in the bottom face of the receiving space (21). A circuit board (50) has multiple light bulbs (51) (preferably light emitting diodes, LEDs) provided on top of the circuit board (50).

Figure 3:
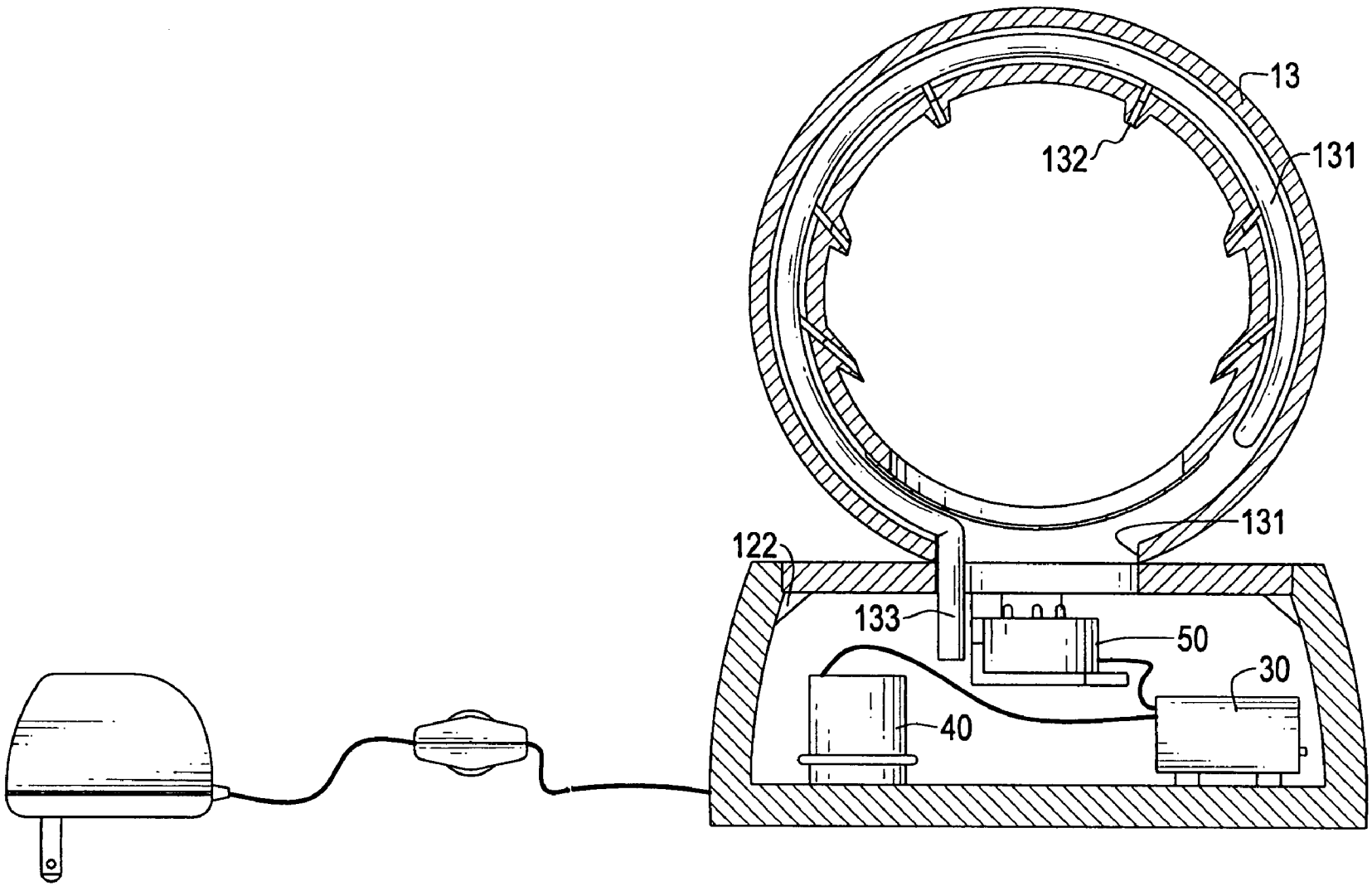
FIG. 3 is schematic cross sectional view of the decorative fountain of the present invention.

With reference to FIG. 3, when the decorative fountain of the present invention is in assembly, the circuit board (50) is received in the seat (113) from the side hole (114) of the seat (113) and an electrical wire (60) connecting the circuit board (50) to the pump (30) is extended out of the reservoir (20) from the plug (40). Thereafter, the base (11) is placed on top of the reservoir (20) to be supported by the ledges (22) in the receiving space (21). Due to the secure engagement between the hollow frame (13) and the base (11), the assembly of the decorative fountain is accomplished after the base (11) is supported on top of the receiving space (21) of the reservoir (20).

Figure 4:
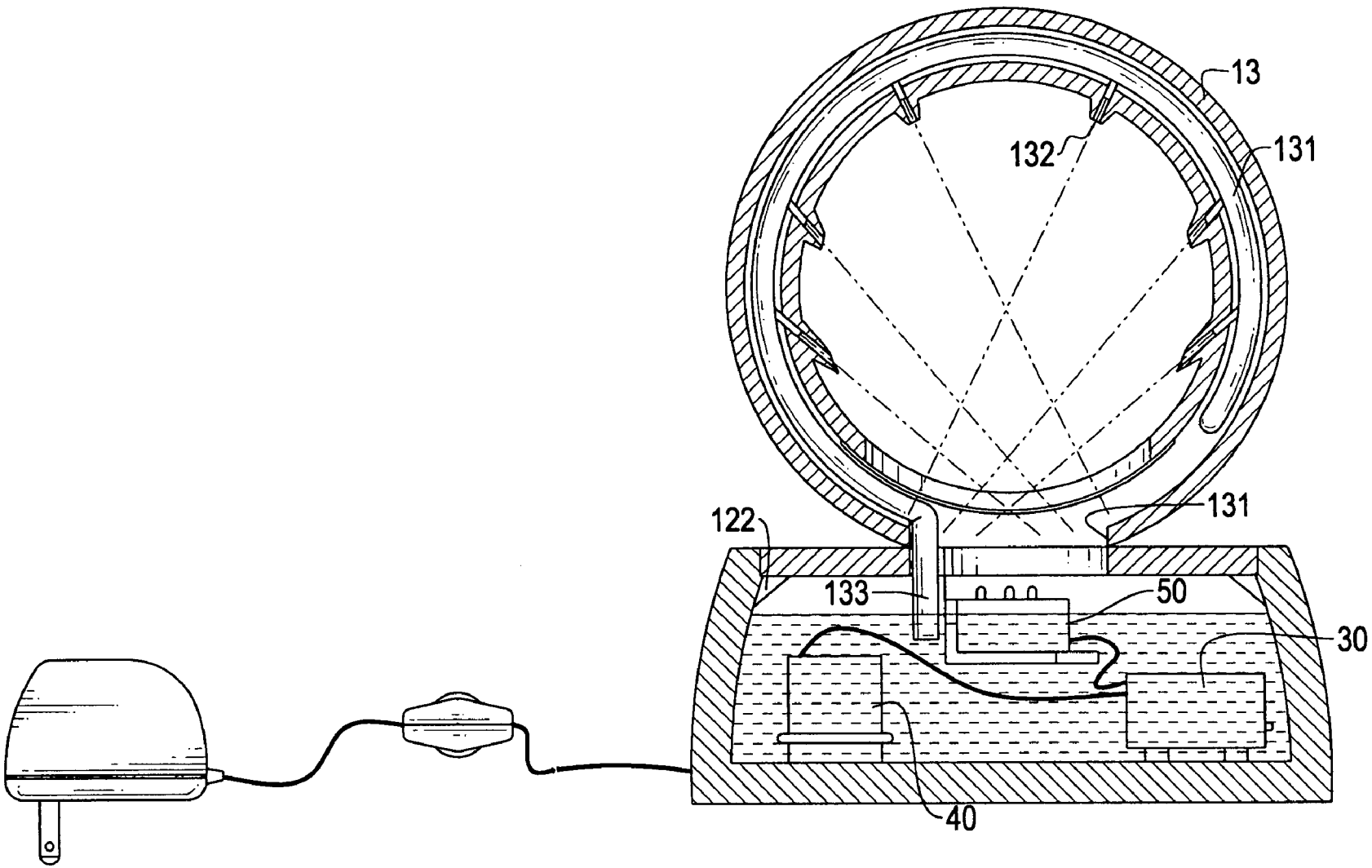
FIG. 4 is a schematic view showing the operation of the decorative fountain, wherein the water is spouted in an interlaced manner and light bulbs illuminate with different colors such that an unexpected ornamental effect is presented.

With reference to FIG. 4 and taking FIG. 2 for reference, after the assembly of the decorative fountain of the present invention, the user may fill the receiving space (21) of the reservoir (20) with water such that the pump (30) and the plug (40) as well as the inlet (133) of the hose (131) are all immersed in the water. Therefore, when the pump (30) is activated, the water received in the reservoir (20) will be pumped upward and enters the hose (131) via the inlet (133). Then, the water in the hose (131) will be spouted out from the outlets (132) and flow back into the reservoir (20) via the screen (135) to filter out foreign objects in the water. It is to be noted that when the water is being sprinkled, due to the angles of the outlets (132), the water trajectories spouted from each of the outlets (132) interlace with one another to form multiple different shapes, which is able to present an interesting entertainment effect.

When the water is being circulated, the LEDs (51) on the circuit board (50) are lit and able to emit different colors, which accompanies the multiple different interlaced shapes of water trajectories formed by ejected water from the outlets (132) and presents a colorful and changeable effect.

Due to the constant change of light colors from the LEDs (51) from the control of the circuit board (50), the observer is able to watch the decorative fountain for a long period of time without feeling bored.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A decorative fountain comprising:

a reservoir defined with a receiving space inside the reservoir for receiving therein water; a pump received in the receiving space for pumping water upward from the reservoir;

a base detachably mounted on top of the reservoir to cover the receiving space and having a through hole in alignment with the receiving space, a seat mounted around a periphery defining the through hole and having a side hole defined in a side wall of the seat;

a circuit board received in the seat from the side hole of the seat; and a hollow frame mounted on top of the base and provided with a hose received in the hollow frame and having an inlet extending from an opening in a bottom face of the hollow frame to the aligned through hole and the receiving space and multiple outlets defined along a periphery of the hose and extending out from an inner periphery of the hollow frame, whereby the outlets are so arranged that when the water in the receiving space is pumped upward and sprinkled out from the outlets, water trajectories from the outlets are interlaced with one another to present an interesting ornamental effect.

2. The decorative fountain as claimed in claim 1, wherein the circuit board has multiple light emitting diodes mounted on the circuit board and which are able to be illuminated by the circuit board to emit different colors so that the interlaced water trajectories together with the changeable color from the light emitting diodes is able to present an interesting effect.

3. The decorative fountain as claimed in claim 2, wherein a screen is provided on top of the opening to cover the opening to filter out foreign objects in the water.

4. The decorative fountain as claimed in claim 2, wherein a ledge is formed between two adjacent walls of the reservoir to support the base.

5. The decorative fountain as claimed in claim 3, wherein a ledge is formed between two adjacent walls of the reservoir to support the base.

* * * * *